United States Patent [19]

Eastman

[11] 4,066,002

[45] Jan. 3, 1978

BEST AVAILABLE COPY

[54] FLUID PRESSURE OPERATED ROTARY STEPPER ACTUATOR

[75] Inventor: James M. Eastman, South Bend, Ind.

[73] Assignee: The Bendix Corporation, South Bend, Ind.

[21] Appl. No.: 695,663

[22] Filed: June 14, 1976

[51] Int. Cl.[2] ..... F15B 21/02; F01B 1/06

[52] U.S. Cl. ..... 91/36; 91/492

[58] Field of Search ..... 91/476–481, 91/491, 492, 35, 36

[56] References Cited

U.S. PATENT DOCUMENTS

| | | | |
|---|---|---|---|
| 2,095,255 | 10/1937 | Holmes | 91/498 |
| 2,712,301 | 7/1955 | Gravely | 91/498 |
| 3,075,504 | 1/1963 | Vogel | 91/491 |
| 3,583,286 | 6/1971 | Chiappulini | 91/491 |
| 3,599,536 | 8/1971 | Meyers | 91/502 |
| 3,661,059 | 5/1972 | Hunter | 91/499 |
| 3,721,158 | 3/1973 | D'Addca et al. | 91/35 |

FOREIGN PATENT DOCUMENTS

| | | | |
|---|---|---|---|
| 889,411 | 2/1962 | United Kingdom | 91/491 |

*Primary Examiner*—William L. Freeh

*Attorney, Agent, or Firm*—Joseph P. Kulik; Ken C. Decker; William N. Antonis

[57] ABSTRACT

A rotary stepper actuator having a rotatable output shaft provided with a cam portion fixedly secured thereto and engaged by a plurality of pairs of oppositely acting fluid pressure responsive pistons wherein each pair of pistons is movable along an axis intersecting the axis of the shaft. Preferably, the pistons are arranged in circumferentially spaced apart formation around the shaft and provided with roller elements adapted to bear against the cam portion the periphery of which takes the general form of an ellipse having opposite depressed mid portions. The applied piston forces acting through the rollers against the peripheral edge of the crank portion produce a force couple tending to rotate the shaft to the extent that the rollers become engaged with the opposite depressed mid portions whereupon the couple becomes reversed preventing further rotation of the shaft. By sequential pressurization of the plurality of pairs of pistons, the cam portion and thus the shaft connected thereto is made to rotate in one or more discrete steps or stepping motion. If desired, the plurality of pairs of pistons may be arranged in so-called "pancake" formation in which case the shaft is provided with a plurality of axially spaced apart cam portions corresponding to the plurality of pairs of pistons.

11 Claims, 6 Drawing Figures

FLUID PRESSURE OPERATED ROTARY STEPPER ACTUATOR

BACKGROUND OF THE INVENTION

Rotary stepper actuators or motors wherein an output shaft thereof is rotated in discrete steps in response to one or more sensed input signals are well known in the art of control mechanisms and have taken various forms as, for example, the pneumatically operated nutating motor of U.S. Pat. No. 3,486,518 and the electrically operated nutating motor of U.S. Pat. No. 3,322,984. Such prior art nutating or stepper motors are not entirely satisfactory for use in certain operational environments wherein size, weight, system complexity, resistance to heat and/or vibration and reliability are of prime concern. The present invention represents an improvement over such prior art stepper actuators or motors in that it provides a relatively structurally simple, compact, reliable stepper motor which is highly resistant to adverse effects created by excessive heat and/or vibration, and capable of high power output.

SUMMARY OF THE INVENTION

The present invention relates to fluid pressure operated stepper actuators or motors having a rotatable output shaft movable in discrete angular steps in response to a sensed input signal.

It is an object of the present invention to provide a pressurized fluid actuated stepper actuator including a rotatable output shaft and force producing means responsive to the pressurized fluid for actuating the shaft a predetermined angular increment.

It is another object of the present invention to provide a stepper actuator or motor having a rotatable output shaft and a plurality of fluid pressure responsive means connected thereto for actuating the shaft a predetermined angular step in response to pressurization of one of said pressure responsive means and a series of the angular steps in response to sequential pressurization of the remaining fluid pressure responsive means.

It is an important object of the present invention to provide a compact and structurally simple fluid pressure operated stepper actuator or motor.

Other objects and advantages of the present invention will be apparent from the following description and accompanying drawings.

DESCRIPTION OF THE INVENTION

Figure 1:
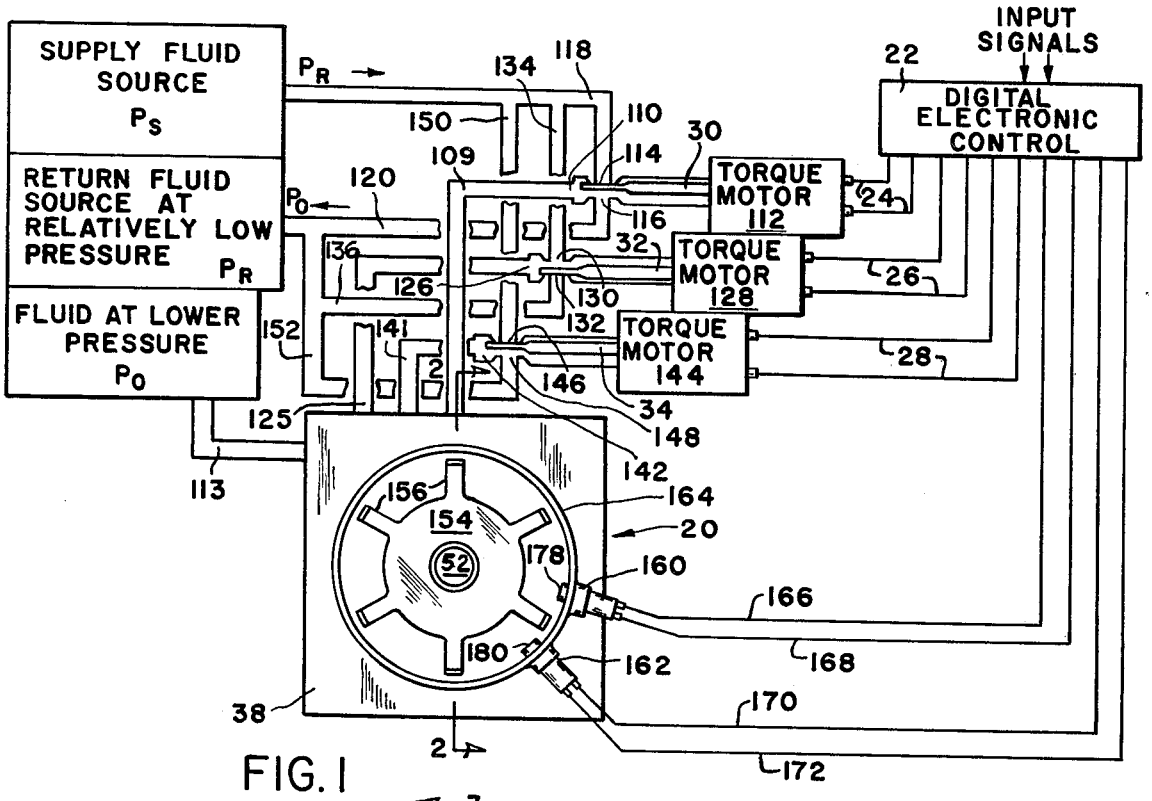
FIG. 1 is a schematic representation of the present invention.
Figure 2:
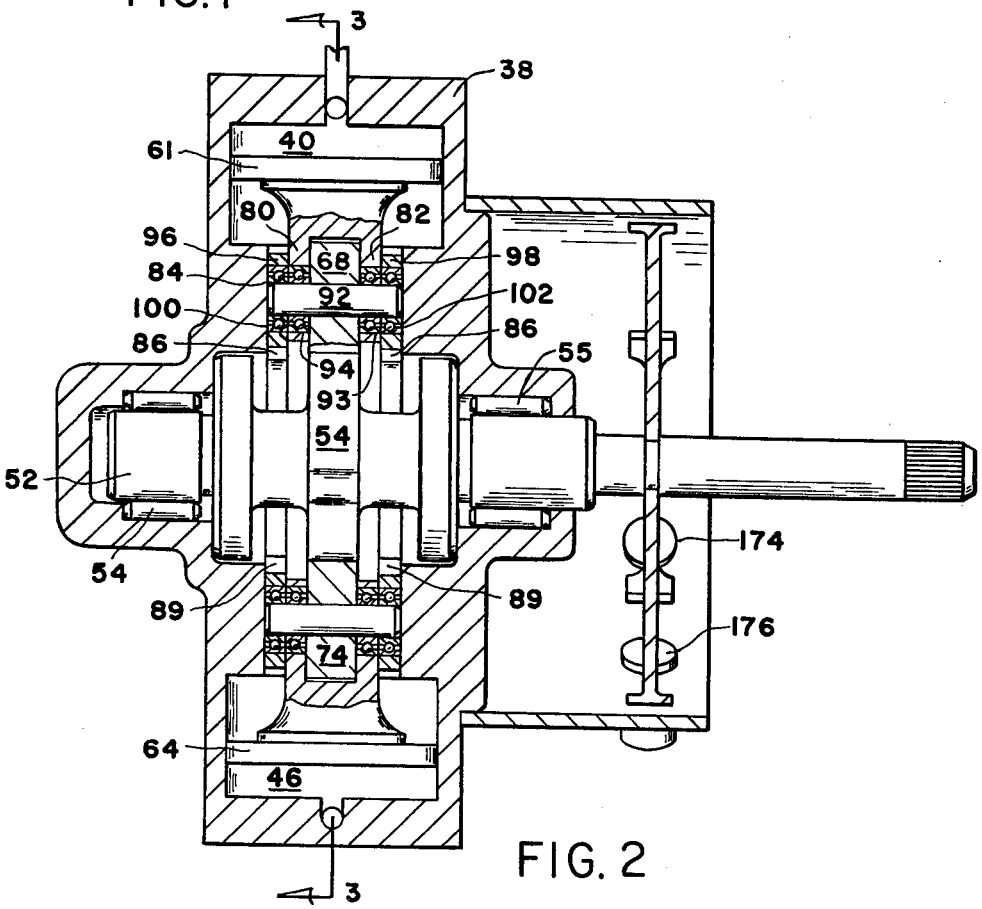
FIG. 2 is a section view taken on line 2—2 of FIG. 1 and shown in enlarged form.
Figure 3:
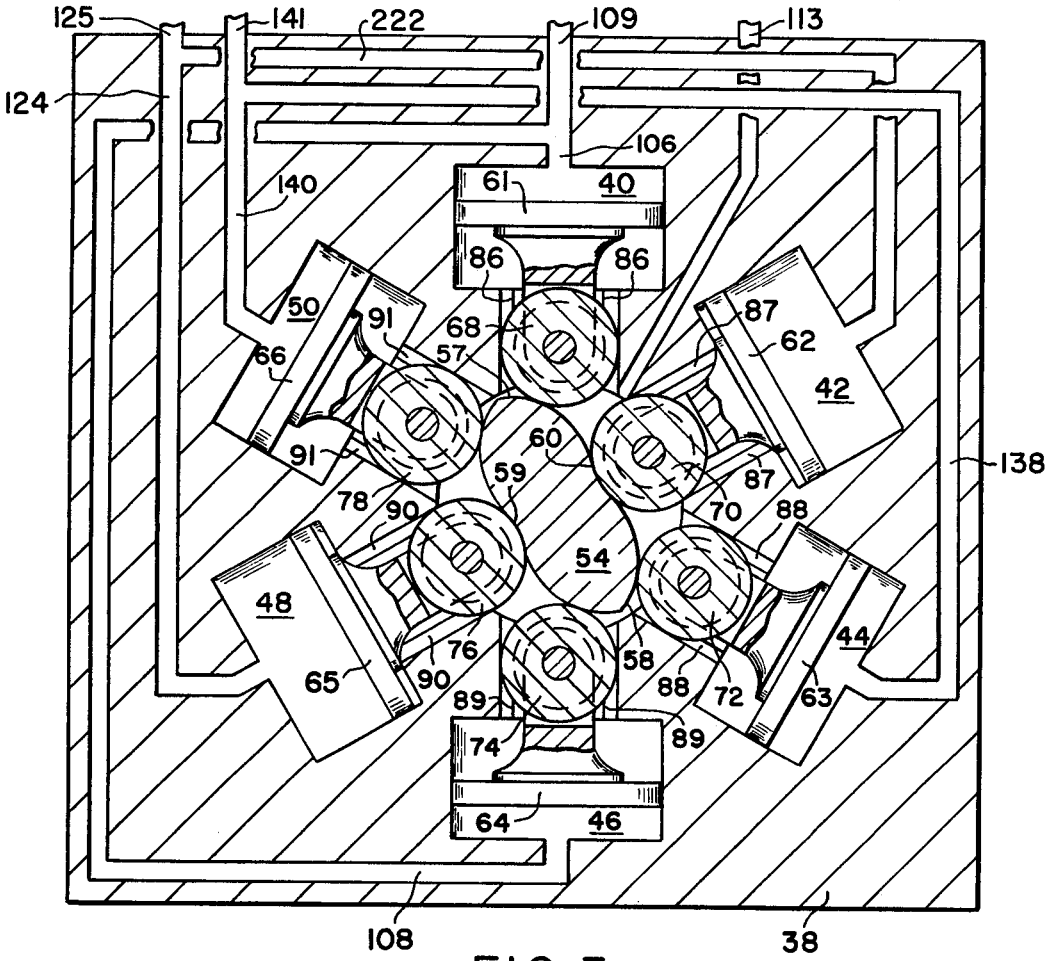
FIG. 3 is a section view taken on line 3—3 of FIG. 2.

Referring to FIGS. 1, 2 and 3, numeral 20 designates a stepper actuator and 22 a conventional electronic control device suitably connected via wire leads 24, 26 and 28 to a plurality of electrically actuated valves generally indicated by 30, 32, and 34, respectively, which, in turn, control fluid pressurization of a plurality of pistons, to be described, to thereby actuate the stepper actuator 20 as will be described. The valves may be actuated by electrical torquemotors as shown, or by electrical solenoids.

The stepper actuator or motor 20 includes a casing 38 having spaced apart cylinders 40, 42, 44, 46, 48 and 50 arranged in radial formation about an output shaft 52 suitably journaled in casing 38 as at 54 and 55 for rotational movement. The output shaft 52 is provided with a generally elliptically shaped cam member 54 integral therewith or otherwise fixedly secured thereto and coaxial therewith. As shown, the cam member 54 has a continuous curved periphery the opposite outwardly curved end portions 57 and 58 which are symmetrical as are the opposite inwardly curved side portions 59 and 60 joining the ends. The cylinders 40, 42, 44, 46, 48 and 50 contain pistons 61, 62, 63, 64, 65 and 66, respectively, which are slidably contained therein and adapted to actuate rollers 68, 70, 72, 74, 76 and 78, respectively. Each piston 61 through 66 is provided with spaced apart parallel arms 80 and 82 which extend therefrom through a stepped rectangular opening 84 in body 38 having spaced apart longitudinally extending recesses defining track portions 86, 87, 88, 89, 90, and 91.

A shaft or axle 92 is rotatably secured to arms 80 and 82 by means of bearings 93 and 94, respectively. Spaced apart roller members 96 and 98 are rotatably secured to opposite ends of axle 92 by bearings 100 and 102, respectively, and are adapted to ride in track portions 86, 87, 88, 89, 90, or 91. A relatively larger diameter roller member corresponding to each of the roller members 68 to 78 is mounted on axle 92 between arms 80 and 82 and bears against the curved edge of cam member 54 to provide a driving force against cam member 54 to rotate shaft 52 as will be described.

Each pair of radially opposed pistons 61, 64; 62, 65; and 63, 66 is arranged to be simultaneously pressurized by a controlled pressurized fluid supplied thereto. To that end, chambers 40 and 46 on one side of pistons 61 and 64, respectively, are vented via passages 106 and 108, respectively, to a passage 109 leading to the outlet port 110 of conventional three-way flapper valve unit 30 operated by a torque motor 112. The radial inner side of each of the pistons 61, 62, 63, 64, 65 and 66 is exposed to the interior of casing 38 which is vented via a passage 113 to a drain fluid source at pressure $P_O$. The flapper valve unit 30 is provided with spaced apart orifices 114 and 116 connected to passages 118 and 120, respectively, which, in turn, communicate with a source of pressurized fluid at pressure $P_S$ and the relatively lower pressure source of return pressurized fluid at return pressure $P_R$, respectively. Return pressure $P_R$ is somewhat higher than drain pressure $P_O$, to provide a minimum force for holding pistons 61, 62, 63, 64, 65 and 66 in engagement with cam 54.

The second pair of opposed pistons 62 and 65 is pressurized via passages 122 and 124, respectively, connecting respective chambers 42 and 48 to a passage 125 leading to the outlet port 126 of the second conventional three-way flapper valve unit 32 operated by a torque motor 128 which includes spaced apart orifices 130 and 132 connected via passages 134 and 136, respectively, to pressurized fluid sources $P_S$ and $P_R$.

The third pair of opposed pistons 63 and 66 is pressurized via passages 138 and 140 connecting respective chambers 44 and 50 to a passage 141 leading to the outlet 142 of the third conventional three-way flapper valve unit 34 operated by a torque motor 144 and provided with spaced apart orifices 146 and 148 connected via passages 150 and 152, respectively, to supply pressurized fluid source $P_S$ and return pressure $P_R$, respectively.

The torque motors 112, 128, and 144 are electrically energized through associated leads 24, 26 and 28 in response to the electrical output signals produced by electronic control device 22, which thus selects stepper motor position in relation to its input signals as required for its control function. In any event, it will be understood that the output shaft 52 is caused to rotate in angular steps as a function of one or more input signals processed by the electronic control device 22. The electronic control device 22 is conventional in structure and operation and is preferably of the well known digital acting type.

A position feedback network includes a circular member 154 fixedly secured to shaft 52 and provided with circumferentialy spaced apart outwardly extending arms 156 made of a suitable magnetic or conducting material. A pair of circumferentially spaced apart conventional proximity sensors 160 and 162 suitably secured to a fixed support such as circular housing 164 surrounding circular member 154 and integral with or otherwise fixedly secured to casing 38 are wired to control device 22 via electrical leads 166, 168 and 170, 172, respectively. The housing 164 is provided with circumferentially spaced apart openings 174 and 176 adapted to receive proximity sensors 160 and 162, respectively, which are fixedly secured in position by any suitable fastening means, not shown, thereby locating ends 178 and 180 of sensors 160 and 162, respectively, in radial spaced relationship to arms 156. The arcuate spacing of arms 156 is different than the arcuate spacing of proximity sensors 160 and 162 to permit the sensors 160 and 162 to determine the direction of rotation, as well as count steps made by shaft 52. To that end, as viewed in FIG. 1, rotation of shaft 52 in a clockwise direction from the position shown results in arm 156 moving across end 180 which produces an output electrical pulse followed by a second electrical pulse generated at sensor 160 by the following arm 156 moving across end 178. In the reverse direction of rotation of shaft 52, the pulse sequence is reversed from that described above for clockwise rotation in that the arm 156 sweeps end 178 producing a pulse followed by a second pulse generated by the following arm 156 sweeping end 180. The control device 22 is capable of distinguishing the pulse sequence.

Figure 4:
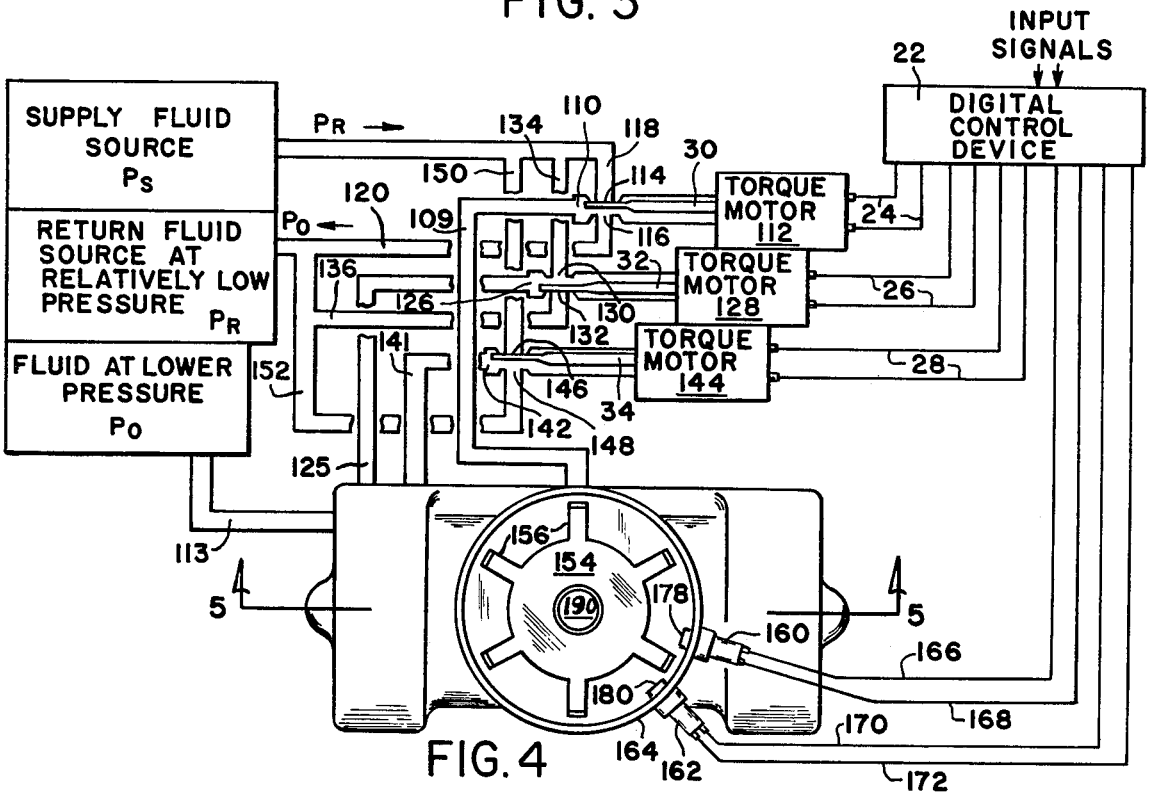
FIG. 4 is a schematic representation of a second embodiment of the present invention.
Figure 5:
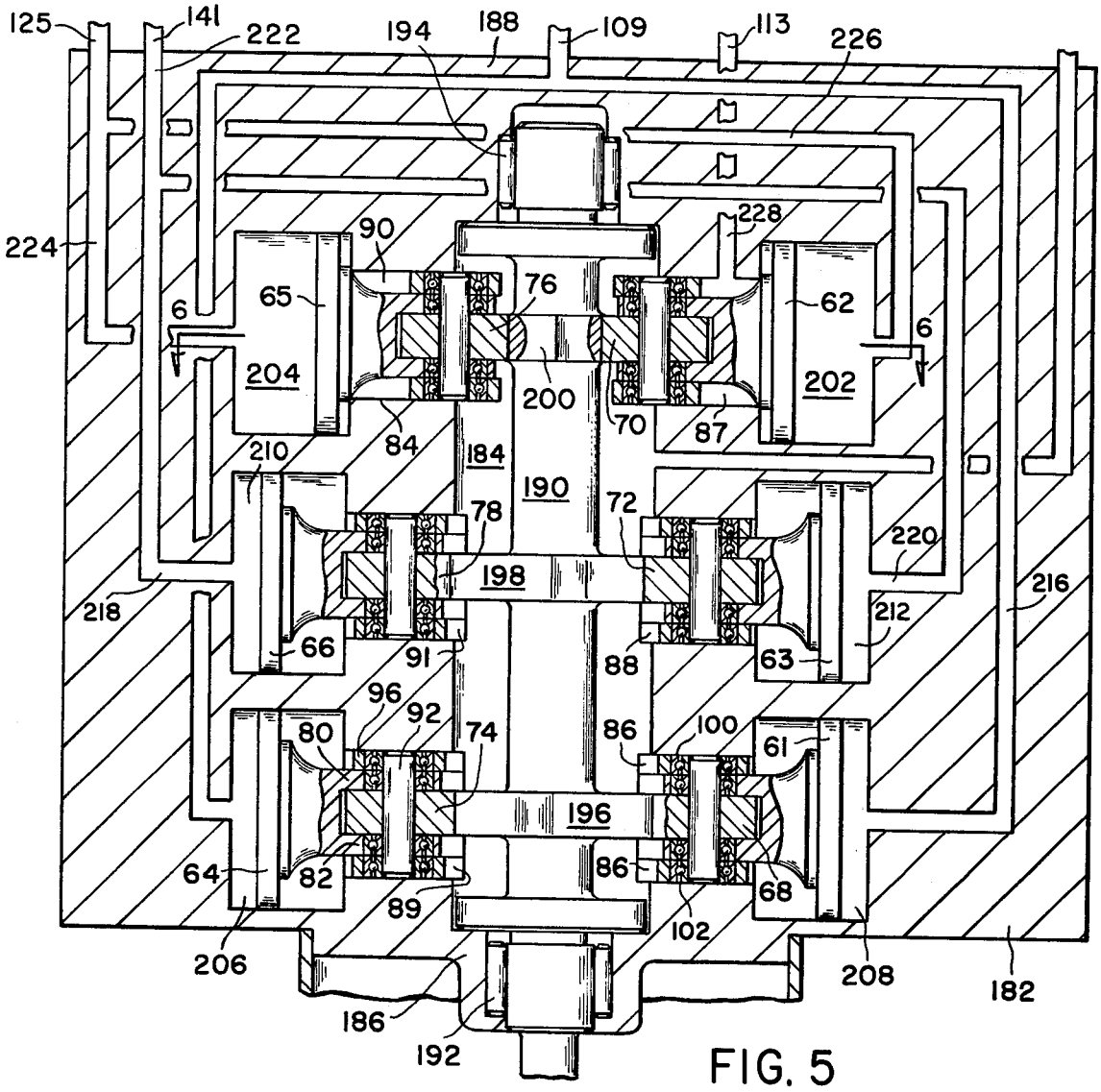
FIG. 5 is a section view taken on line 5—5 of FIG. 4 and shown enlarged.
Figure 6:
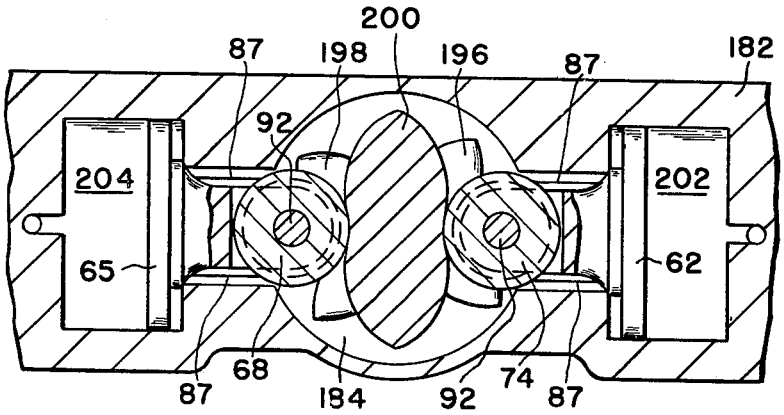
FIG. 6 is a section view taken on line 6—6 of FIG. 5.

Referring to FIGS. 4, 5 and 6 which illustrate a second embodiment of the present invention wherein structure similar to that of FIG. 1 is defined by like numerals, it will be noted that the cylinders and pistons slidable therein are arranged in a so-called "pancake" formation. To that end, an elongated casing generally indicated by 182 defines a longitudinally extending chamber 184 having end walls 186 and 188. A shaft 190 extending through chamber 184 is journaled in bearings 192 and 194 suitably secured in position in end walls 186 and 188, respectively. Shaft 190 extends through end wall 186 to provide an external power take-off. A plurality of generally elliptical cam members 196, 198 and 200, each of which have the shape of cam member 54 heretofore described, are arranged in axially spaced apart formation on shaft 190 coaxial therewith. The cam members 196, 198, and 200 are integral with or otherwise fixedly secured to shaft 190 and are equally spaced angularly relative to the major axes thereof, which spacing, in the case of the three cam members shown, is sixty degrees. Cylinders 202 and 204 on opposite sides of drive member 200 are coaxial, with the axis thereof intersecting the axis of shaft 190. Likewise, cylinders 206 and 208 on opposite sides of cam member 196 are coaxial, with the axis thereof intersecting the axis of shaft 190. Likewise, cylinders 210 and 212 on opposite sides of cam members 198 are coaxial with the axis thereof intersecting the axis of shaft 190. Pistons 62, 65, 64, 61, 66 and 63 are slidably contained by cylinders 202, 204, 206, 208, 210 and 212, respectively, which pistons, as in the case of FIG. 1, are each provided with spaced apart arms 80 and 82 which support 92 on which roller members 96 and 98 are secured. The roller members 68 and 74 of pistons 61 and 64, respectively, bear against cam member 196 to exert oppositely acting forces thereagainst in response to pressurization of pistons 61 and 64. The roller members 72 and 78 of pistons 63 and 66, respectively, bear against cam member 198 to exert oppositely acting forces thereagainst in response to the pressurization of pistons 63 and 66. The roller members 76 and 70 of pistons 65 and 62, respectively, bear against cam member 200 to exert oppositely acting forces thereagainst in response to pressurization of pistons 65 and 62.

The cylinders 202 through 212 each communicate via stepped rectangular opening 84 with chamber 184 which opening is provided with spaced apart track portions 86, 87, 88, 89, 90, and 91 in which roller members 96 and 98 ride.

The cylinders 206 and 208 communicate via passages 214 and 216, respectively, with passage 109 which, in turn, communicates with valve 30. The cylinders 210 and 212 communicate via passages 218 and 220, respectively, with a passage 222 which, in turn, communicates with a passage 141 which, communicates with valve 34. The cylinders 204 and 202 communicate via passages 224 and 226, respectively, with passage 125, which, in turn, communicates with valve 32. The chamber 184 is vented to pressure $P_O$ via passage 228 which communicates passage 113.

As in the case of FIG. 1, the shaft 190 of FIG. 4 may be provided with a position feedback network including circular member 154 fixedly secured to shaft 190 and rotatable therewith to generate an electrical output signal at proximity sensors 160 and 162 which is passed via leads 166, 168, 170 and 172 to control device 22.

Referring to FIGS. 1, 2 and 3, the stepper actuator 20 will be considered fixed in position as shown in response to the control device 22 which imposes electrical output signals on the torque motors 112, 128, 144 to hold control valves 30, 32 and 34, respectively, in position as shown. It will be noted that pistons 61, 64, 63 and 66 are vented to relatively low return pressure $P_R$ and pistons 62 and 65 are vented to supply pressure $P_S$ resulting in rollers 70 and 76 being forced against curved side portions 60 and 59, respectively, thereby resisting movement of cam member 54 in either direction.

Assuming a change in the input signals imposed on control device 22, the latter will cause a corresponding variation in output signals to the torque motors 112, 128, 144 depending upon the degree of change in response to said input signal change. Assuming that the input signal change dictates corrective movement of shaft 52 in a clockwise direction as viewed in FIG. 3, the torque motor 144 is energized to move valve 34 against orifice 148 thereby venting supply pressure $P_S$ to pistons 63 and 66 and torque motor 128 is energized to move valve 32 against orifice 130 thereby venting pistons 62 and 65 to return pressure $P_R$. Torque motor 112 remains in its previously energized mode thereby holding valve 30 against orifice 114 which, in turn, vents pressure $P_R$ to pistons 61 and 64. The equal and opposite forces generated by pistons 63 and 66 are imposed against end portions 58 and 57, respectively, producing a force couple urging cam member 54 in a clockwise direction. The pistons 61, 64, 62 and 65, being exposed to relatively low pressure $P_R$, are pushed back into the respective cylinders 40, 46, 42 and 48 by cam member 54. Since piston return pressure $P_R$ is slightly higher than the center chamber pressure $P_O$, rollers 68, 74, 70, and 76 remain engaged with the cam. As the cam member 54 turns under the influence of rollers 72 and 78 loaded by pistons 63 and 66, respectively, the curved side portions 59 and 60 are brought into alignment with rollers 78 and 72, respectively, whereupon the lines of action of the opposing forces imposed by rollers 78 and 72 against cam member 54 become colinear through the axis of the cam member 54. It will be noted that the effective lever arms of cam member 54 as well as the respective force vectors acting therethrough of roller members 78 and 72 progressively decrease as the cam member 54 rotates, thereby causing a corresponding reduction in the force couple acting on cam member 54 as the curved side portions 59 and 60 move into alignment with 78 and 72, respectively. Upon alignment of the curved side portions 59 and 60 with rollers 78 and 72, respectively, the cam member 54 is held against further movement in either direction. For example, any external load tending to rotate shaft 52 and cam member 54 secured thereto in either direction will be resisted by an opposing force couple generated by rollers 78 and 72 which tend to roll out of side portions 59 and 60 as cam member 54 moves.

In the event that the input signals sensed by control device 22 demand continued stepping movement of the cam member 54, the output signals impressed on torque motors 112, 128 and 144 will be such that valve 30 is actuated against orifice 116 thereby venting pistons 61 and 64 to supply pressure $P_S$ valve 32 is maintained against orifice 130 thereby venting pistons 62 and 65 to return pressure $P_R$ and valve 34 is actuated against orifice 146 thereby venting pistons 63 and 66 to return pressure $P_R$. The cam member 54, now being urged in a clockwise direction by a force couple derived from rollers 68 and 74 loaded by pistons 61 and 64, respectively, rotates and pushes pistons 62 and 65 into cylinders 42 and 48, respectively. Cam member 54 continues to rotate under the influence of pistons 61 and 64 until rollers 68 and 74 are aligned with curved side portions 59 and 60, respectively, in the heretofore mentioned manner of rollers 78 and 72 whereupon cam member 54 will become stabilized unless control device 22 continues to signal torquemotors 112, 128, and 144 to move so as to command continued stepping in the fashion described. It will be recognized that continued stepping action of cam member 54 and thus shaft 52 in the above-mentioned manner may be made to occur by sequential pressurization of each pair of pistons 63, 66; 61, 64; and 62, 65 with supply pressure $P_S$ in a clockwise pattern until the desired shaft 52 position is attained.

The cam member 54 may be made to turn in a reverse sense by reversing the above-mentioned sequence of pressurization of the pairs of pistons 63, 66; 61, 64; and 62, 65. For example, as viewed in FIG. 3, the cam member 54 may be made to rotate in a counterclockwise direction through one step by pressurization of pistons 61 and 64 with supply pressure $P_S$ and the remaining pairs of pistons 63, 66 and 62, 65 with return pressure $P_R$. If additional steps of cam member 54 are required, the pairs of pistons 63, 66 and 62, 65 as well as 61, 64 are pressurized in sequence in the order named by supply pressure $P_S$.

It will be understood that the arcuate movement of cam member 54 for each step made in the above-mentioned manner is dependent upon the number of pairs of pistons utilized. For example, with reference to FIG. 3 wherein three pairs of pistons are shown, each step will be sixty degrees. The pairs of pistons may be increased or decreased to establish smaller or larger step movement, respectively, as desired.

It will be understood that the pressurized sources of fluid $P_S$ and $P_R$ may be liquid or gas. Conventional fluid seals, not shown, may be provided where required to minimize fluid leakage from pressure $P_S$ to relatively lower pressure $P_R$.

Referring to FIGS. 4, 5 and 6, operation of the rotary stepper actuator shown therein is substantially the same as that described above with regard to FIGS. 1, 2 and 3 in that the pressurization sequence of valves 30, 32 and 34 and response of pistons 61, 64; 62, 65; and 63, 66 thereto produces identical stepping action of the shaft 190. The primary distinction between the formation of FIGS. 4, 5 and 6 and radial formation of FIGS. 1, 2 and 3 is that each pair of pistons 61, 64; 63, 66; and 62, 65 acts against its associated cam member 196, 198 and 200, respectively.

It will be recognized that various changes or modifications in the above described apparatus may be made without departing from the scope of applicant's invention as set forth in the following claims.

I claim:

1. A rotary stepper actuator comprising:

a casing:

a shaft mounted in said casing for rotation about its axis;

cam means coaxial with and fixedly secured to said shaft for rotating the same, said cam means being generally elliptical in shape having major and minor axes perpendicular to said axis of rotation, said major axis defining radially opposite elongated portions, said cam having opposite recessed portions radially inwardly from the ends of said minor axis, said elongated portions joining said recessed portions to define a continuous surface, said surface being symmetrical about said major and minor axis;

a first source of pressurized fluid;

a second source of pressurized fluid at a relatively lower pressure compared to said first source;

force producing means contained by said casing including at least three pairs of fluid pressure responsive pistons in a radially spaced relationship about said shaft's axis of rotation, each said piston pair being axially aligned in the same radial plane through said shaft's axis of rotation in a radial force opposing relationship, with each said piston in a radially measured equal angular spaced relationship from each said adjacent piston, each said piston pair operatively engaging said cam's surface for imposing an oppositely directed force couple thereon in response to said first source of pressurized fluid;

valve means including conduit means for fluidly connecting said first and second sources of pressurized fluid with said piston pairs;

said first source of pressurized fluid initially communicated to one said piston pair which is engaged with said opposite recessed portions of said cam's surface thereby providing a positive piston lock on said cam; and control means operatively connected to said valve means for actuating the same to selectively communicate said first source of pressurized fluid to one of said piston pairs adjacent said piston pair that is providing said positive position lock and said second source of pressurized fluid to the remaining piston pairs thereby rotating said cam a predetermined angular increment until said selected piston pair receiving said first source of pressurized fluid engages said recessed portion of said cam's surface to create another said positive position lock.

2. A rotary stepper actuator as claimed in claim 1 wherein:

said control means is further adapted to continue selectively communicating said first and second sources of pressurized fluid to said piston pairs whereby said shaft rotates a predetermined series of said predetermined angular increments and creating only one said positive position lock on said cam at the end of said increment series.

3. A rotary stepper actuator as claimed in claim 2 wherein:

said predetermined angular increment of movement of said shaft is dependent upon the number of said pairs of pistons.

4. A rotary stepper actuator as claimed in claim 3, wherein:

said piston pairs are slidably contained by said casing and each said piston is provided with arm means adapted to support first and second roller means;

said first roller means is engaged with and guided by track means formed in said casing;

said second roller means bears against said cam's surface.

5. A rotary stepper actuator as claimed in claim 4 wherein:

said valve means includes a separate valve for each of said pairs of pistons; and said control means includes actuating means for each of said separate valves.

6. A rotary stepper actuator as claimed in claim 5 wherein:

said valve means includes a plurality of electrical torque motor actuated valve members operatively connected to said conduit means in flow controlling relationship with said first and second sources of pressurized fluid; and said control means includes electronic control apparatus operative to generate a plurality of electrical output signals corresponding to said plurality of torque motor actuated valves for energizing the same.

7. A rotary stepper actuator as claimed in claim 6 and further including:

position feedback means operatively connected to said shaft and said control means for transmitting a position signal of said shaft to said control means, said feedback means including:

a circular member fixedly secured to said shaft having a plurality of circumferentially spaced apart radially outwardly extending signal arm members; and a plurality of circumferentially spaced apart sensor members located radially outwardly beyond said signal arm members, said sensor members adapted to generate an electrical signal when one said signal arm member rotates across said sensor members' radial path;

said arcuate spacing of said sensor members being different than said arcuate spacing of said signal arm members in order to determine the direction of rotation.

8. A rotary stepper actuator comprising:

a casing;

a shaft mounted in said casing for rotation about its axis;

at least three cam members disposed along said shaft and fixedly secured thereto for rotating the same, said cam members being identically shaped having a generally elliptical shape with major and minor axis perpendicular to said axis of rotation, said major axis defining radially opposite elongated portions, each said cam member having opposite recessed portions radially inwardly from the ends of said minor axis, said elongated portions joining said recessed portions to define a continuous surface, said surface being symmetrical about said major and minor axis;

said cam members adapted to have each said major axis in a radially measured equal angular spaced relationship about said shaft's axis of rotation;

a first source of pressurized fluid;

a second source of pressurized fluid at a relatively lower pressure compared to said first source;

force producing means contained by said casing including a number of pairs of fluid pressure responsive pistons equal to the number of said cam members, said piston pairs being disposed in a spaced relationship along said shaft's axis of rotation, each said piston pair being axially aligned in the same axial plane through said shaft's axis of rotation in a radial force opposing relationship, each said piston pair operatively engaging its respective cam's surface for imposing an oppositely directed force couple thereon in response to said first source of pressurized fluid;

valve means including conduit means for fluidly connecting said first and second sources of pressurized fluid with said piston pairs;

said first source of pressurized fluid initially communicated to one said piston pair which is engaged with said opposite recessed portions of its respective said cam's surface thereby providing a positive position lock on said cam; and control means operatively connected to said valve means for actuating the same to selectively communicate said first source of pressurized fluid to one of said piston pairs which is radially adjacent said recessed portion of its respective said cam surface and said second source of pressurized fluid to the remaining piston pairs thereby rotating said cam a predetermined angular increment until said selected piston pair receiving said first source of pressurized fluid engages said recessed portion of said cam's surface to create another said positive position lock.

9. A rotary stepper actuator as claimed in claim 8, wherein:

said control means is further adapted to continue selectively communicating said first and second sources of pressurized fluid to said piston pairs whereby said shaft rotates a predetermined series of said predetermined angular increments and creating only one said positive position lock on said cam at the end of said increment series.

10. A rotary stepper actuator as claimed in claim 9, wherein:

said predetermined angular increment of movement of said shaft is dependent upon the number of said cam members.

11. A rotary stepper actuator as claimed in claim 10, wherein:

said piston pairs are slidably contained by said casing and each said piston is provided with arm means adapted to support first and second roller means;

said first roller means is engaged with and guided by track means formed in said casing;

said second roller means bears against said cam's surface.

* * * * *